US005101698A

United States Patent [19]

Paradiso

[11] Patent Number: 5,101,698

[45] Date of Patent: Apr. 7, 1992

[54] SCREW HEAD DEPTH LIMITER

[76] Inventor: Bernardo Paradiso, 50-22 Ireland St., Elmhurst, N.Y. 11373

[21] Appl. No.: 528,224

[22] Filed: May 24, 1990

[51] Int. Cl.[5] ..... B25B 23/08
[52] U.S. Cl. ..... 81/451; 81/180.1
[58] Field of Search ..... 81/436, 451, 180.1, 81/184

[56] References Cited

U.S. PATENT DOCUMENTS 1,644,074 10/1927 Morgan ..... 81/451 X

FOREIGN PATENT DOCUMENTS 225620 12/1924 United Kingdom ..... 81/451
700536 12/1953 United Kingdom ..... 81/451

*Primary Examiner*—James G. Smith
*Attorney, Agent, or Firm*—Bauer & Schaffer

[57] ABSTRACT

A screw head depth limiter which is a collar having a bore therethrough and adapted to fit frictionally over a screwdriver tip with the tip protruding through the front end of the collar and a step located in the vicinity of the rear end of the collar on which the screwdriver tip seats. The tip is disengageable from the head of a screw when the front end of the collar counteracts the surface of a workpiece and the desired depth of the screw head in the workpiece is reached.

4 Claims, 1 Drawing Sheet

SCREW HEAD DEPTH LIMITER

The present invention relates to an apparatus for limiting the depth to which a screw is driven into wallboard and the like.

BACKGROUND OF THE INVENTION

When driving screws with a power screw driver, it is generally difficult to determine the proper point at which to stop the driver to define the proper depth of the screw head with respect to the surface of the workpiece. Should the operator of the screwdriver stop too soon, the screw head will protrude from the surface of the workpiece. Consequently, the operator must attempt to advance the screw in small incremental distances until it reaches the desired proper depth. This is difficult to do and in many instances, not successfully achieved. On the other hand, should the operator stop too late, the screw head penetrates into the workpiece to a point below the surface thereof. This may result in damage to the assembly, or, in the case of dry wallboard for example, break the wallboard surface, thus reducing the strength thereof.

While devices currently exist which address the above-mentioned disadvantages, such devices usually rely on torque limiters which must be set prior to driving the screw as such devices cannot sense the location of a screw head in relation to the workpiece nor the torque required to properly seat the screw. Such torque widely varies not only with the material into which the screw is being driven, but with regard to the specific point at which the screw is driven.

There exists therefore, the need for a device to limit the screw head depth which does not exhibit the disadvantages of the above-mentioned devices. The present invention fulfills such a need.

BRIEF STATEMENT OF THE INVENTION

In accordance with this invention, there is provided a screw head depth limiter comprising a collar adapted to fit snugly over the screw drive tip when used on a power drill machine. The collar has a bell shaped front end having a frontal edge adapted for contacting the face of the workpiece, a rear end opposite the front end and a through bore located therein. The bore is provided with a step located in the vicinity of the rear end which is adapted to abut against a shoulder formed on the driver tip. The collar is disposed over the tip which protrudes through the front end of the collar allowing the tip to operatively engage in the head of the screw. The collar is fit on the tip so as to rotate with it under normal conditions, but be arrested when the frontal edge of the collar contacts the workpiece and the desired depth of the screw head in the workpiece is reached.

The screw head depth limiter, in accordance with the present invention, is advantageous in that it not only eliminates the problems of the above-mentioned currently known devices, but also automatically senses the location of the workpiece relative to the head of a screw and disengages from rotation with the screw head at the moment the screw head is properly set in the workpiece. This avoids over driving of the screw or ratcheting of the tip in the screw head. Consequently, an operator need not be highly skilled when using the present device.

Moreover, the inventive screw head depth limiter has an extremely simple construction and thus, can be made at a very low cost. In addition, it has no moving parts. Furthermore, it eliminates the need for a torque limiting device on the screwdriver and an ordinary electric drill can be used therewith, saving unnecessary investment in additional tools.

Further advantages and objects will be apparent from the following disclosure.

THE DRAWINGS

In order to describe the device of the present invention more fully, reference is directed to the accompanying drawings which are to be taken in conjunction with the following description and in which drawings.

DESCRIPTION OF THE PREFERRED EMBODIMENTS

Figure 1:
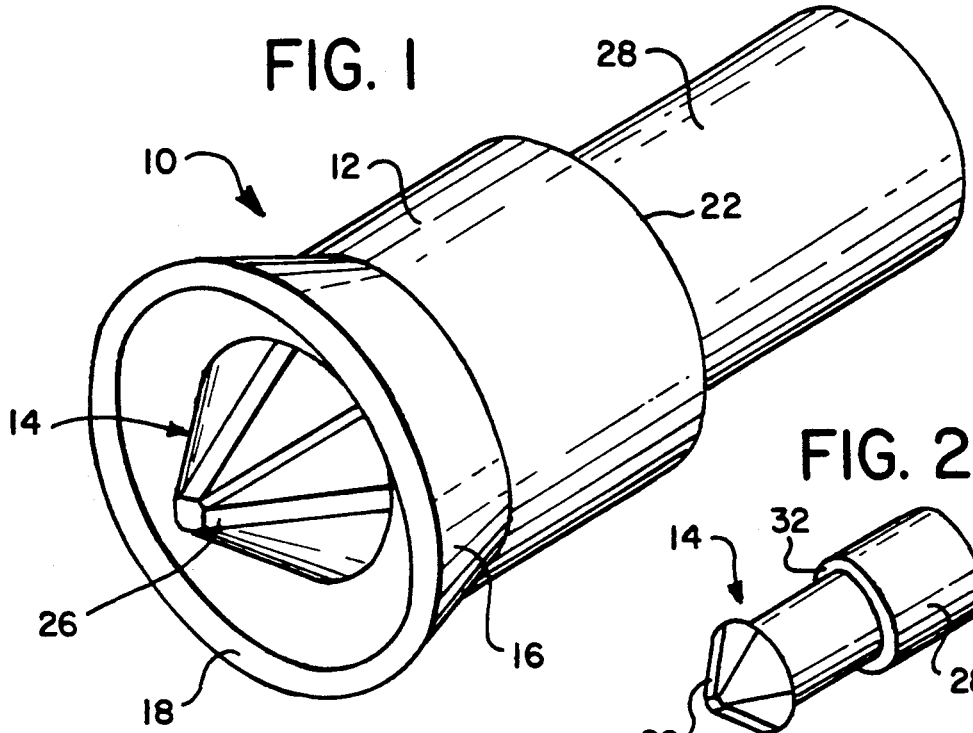
FIG. 1 is a perspective view of the screw head depth limiter of this invention in combination with a screwdriver tip.

Referring more particularly to FIG. 1, a screw head depth limiter, according to the present invention is shown and generally referred to by numeral 10. The device comprises a collar 12 which fits snugly over a screwdriver tip 14 of conventional design. The collar has a bell shaped front end 16 which flares outwardly at a length which allows the tip 14 to protrude beyond the frontal edge 18 of the collar.

Figure 3:
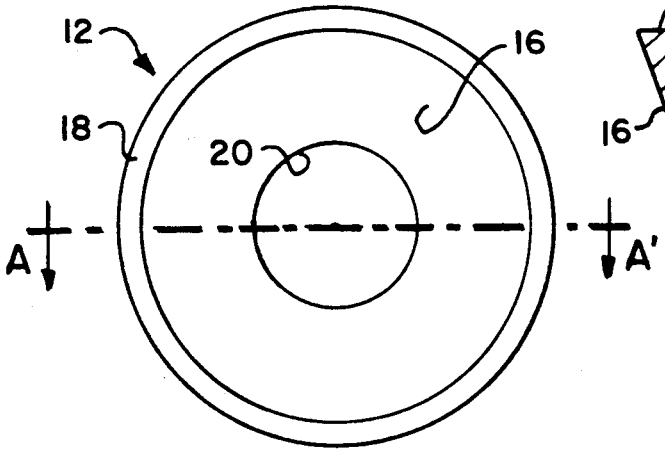
FIG. 3 is a plan view of a screw head depth limiter according to the present invention looking down on the flared front end of the collar.
Figure 4:
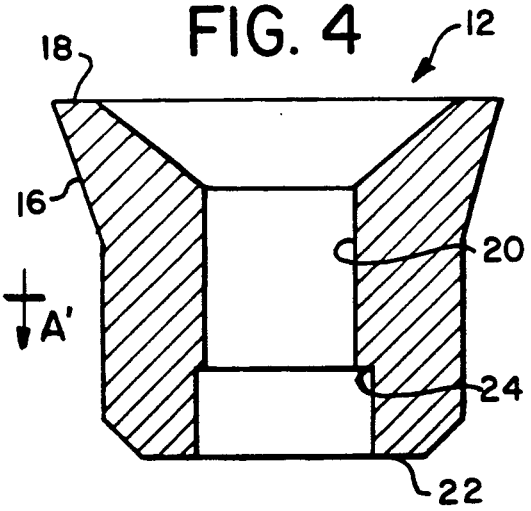
FIG. 4 is a sectional view of the collar illustrated in FIG. 3 and taken across the diameter line A-A' of FIG. 1.

As can be seen from FIGS. 3 and 4, collar 12 is provided with a centrally located internal bore 20 which extends from the flared front end 16 to the rear end 22. The bore 20 is formed with an enlarged step 24 in the vicinity of the rear end 22 and is preferably cylindrical.

Figure 2:
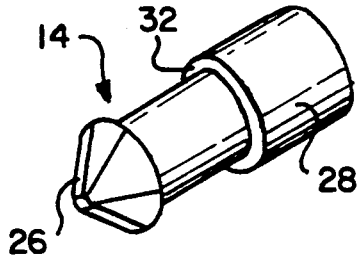
FIG. 2 is a perspective view of the drill tip used in combination with the collar shown in FIG. 1.

The drill tip 14, generally preferred for the present invention, comprises as seen in FIG. 2, a cylindrical rod formed with a tip 26 having a screw engaging configuration at its frontal end and a solid shaft 28 at its rear end, so that it can be conventionally inserted into the chuck of a standard and commonly available power drill. The shaft of drill tip rod 28 is machined to provide a stepped diameter conforming substantially to the inner diameters of the bore 20 and to have a shoulder 32 adapted to abut against the step 24 of the collar. Thus, the collar 12 may be easily force fit over the front end of the drill tip until the step 24 seats against the shoulder 32 establishing the position of the frontal edge 18 relative to the tip 26 of the drill tip 14. Of course, the tip need not be made with the shoulder 32, but the collar 12 can be dimensional so that its rear end abuts against the frontal end of the drill chuck, thereby defining the extent of the protrusion of the front tip of the tip.

Figure 5A:
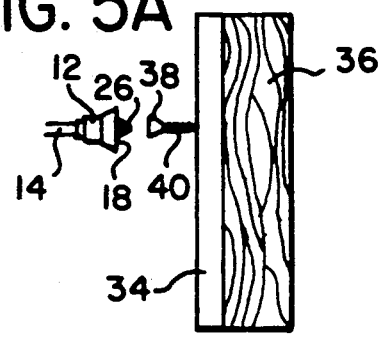
FIGS. 5A and 5B are elevational views showing, in sequence, the application of a screw to a dry wall assembly according to the present invention.
Figure 5B:
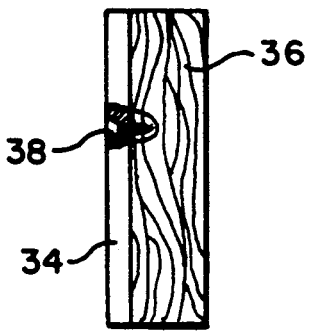

Use of the device of the present invention is readily appreciated from the sequence illustrations in FIGS. 5A to 5B showing the attachment of a dry board 34 to a wall stud 36. A drill tip 14 is first selected for the assembly job at hand, as is the depth limiter collar 12. The collar is placed over the front end of the drill tip and firmly seated step 24 to shoulder 32. It is noted that the tip 26 of the drill tip extends beyond the frontal edge 18 of the collar a distance sufficient only to conform to the depth of the engaging slots in the head 38 of the screw 40. Engagement of the tip 26 with the screw head 38, and driving of the screw, is made thereafter in a conventional manner until, as seen in FIG. 5B, the frontal edge 18 of the depth limiter, engages the face of the dry wall 34. The drill and screw can not be driven further into the wall because engagement of the step 24 of the collar and shoulder 32 drill tip prevent such axial movement. On the other hand, because the collar 12 is only frictionally disposed on the drill tip, the engagement of collar with dry wall arrests rotation of the collar 12 while permitting continued rotation of the drill tip 14. Because the collar 12 stops rotating, very little if any damage occurs to the wall. Because the protruding tip 26 of the drill tip 14 and the depth of the screw slots in the head 34 re substantially equal, the screw is arrested from any movement in a flush condition with the face of the dry wall, as seen in FIG. 5B.

The dimensions of collar 12 may vary widely to allow for different sizes of screwdriver tips 14, it being understood that it fit frictionally over the shank or shaft screwdriver tip, that it have a forward end which contacts the workpiece and prevents further advance of the driver tip and that the protrusion of the tip of the tip from the front end of the collar be appropriate to allow disengagement of the screw head at the desired time when the screw head has reached the desired depth in the workpiece. These features are controlled by the inside diameter of the collar, the flared shape of the front end and the location of the step in the bore of the collar against which the screwdriver tip seats, or the length of the collar so that it seats against the chuck face.

In accordance with the present invention, the protrusion of the tip from the collar is pre-determined by selection to disengage the screwdriver from the head of the screw when the desired screw head depth is reached. This can be pre-set be flush with the workpiece, or raised above or sunk below the surface of the work. The collar illustrated in FIG. 1 is not adjustable. However, the depth is pre-set e.g. by the location of the step in the bore of the collar. Collars with different dimensions can be utilized from different applications requiring different screw head settings, or a field adjustable collar can be made. The simple construction of the collar does not interfere with easy removal and replacement of the tip when needed to be done. A collar, in accordance with this invention, is removable and can be employed with other tips if desired. However, it is to be understood that since the collars are of simple construction and inexpensive to make, they may simply be discarded when a tip is worn out.

A screw head depth limiter, according to the present invention, may be used in a wide variety of areas such as the building trade, manufacturing industry, automotive industry and in any industry where screws are used for assembly, as well as in the "do-it-yourself" market.

Various modifications, changes and embodiments have been disclosed and others will be apparent to those skilled in the art. Accordingly, it is appreciated that the disclosure and description is illustrated only and not limiting in the invention.

What is claimed is:

1. The combination of a drill bit and a screw head depth limiter comprising a collar adapted to fit frictionally over the drill bit, said collar having a front end which is flared outwardly for contacting a workpiece, a rear end located opposite said front end, and a bore extending through said collar from the front end to the rear end thereof, and having a stepped inner diameter forming a shoulder in the vicinity of the rear end of the bore, said drill bit comprising a shaft having a tip at its front end adapted to operationally engage with the head of a screw, a rear end adapted to be secured in the chuck of a drill, and a body conforming in outer diameter to the stepped inner diameter of said bore, said collar being frictionally disposed over the body of said drill bit with the tip of said drill bit protruding through said front end of said collar when the shoulder of said collar and drill bit are in engagement, the frictional engagement of said collar with the body of said drill bit being less than the frictional engagement of said collar with said workpiece, whereby said collar arrests the forward movement of said drill bit, causing said drill bit tip to be disengageable from the head of the screw when said front end of said collar contacts said workpiece.

2. A screw head depth limiter according to claim 1 wherein the shoulder is located in the bore at a distance such that the protrusion of the bit through the collar is pre-set and said bit disengages from the head of a screw when said head is flush with the surface of the workpiece.

3. A screw head depth limiter according to claim 1 wherein the shoulder is located in the bore at a distance that the protrusion of the bit through the collar is pre-set and said bit disengages from the head of a screw when said head is above the surface of the workpiece.

4. A screw head depth limiter according to claim 1 wherein the shoulder is located in the bore at a distance such that the protrusion of the bit through the collar is pre-set and said bit disengages from the head of a screw when said head is sunk below the surface of the workpiece.

* * * * *